US009150390B2

(12) United States Patent
Willim

(10) Patent No.: US 9,150,390 B2
(45) Date of Patent: Oct. 6, 2015

(54) MODULAR MOBILE CRANE

(71) Applicant: Liebherr-Werk Ehingen GmbH, Ehingen/Donau (DE)

(72) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 183 days.

(21) Appl. No.: 13/913,872

(22) Filed: Jun. 10, 2013

(65) Prior Publication Data

US 2014/0023474 A1 Jan. 23, 2014

(30) Foreign Application Priority Data

Jun. 11, 2012 (DE) ..... 10 2012 011 533
Jun. 3, 2013 (DE) ..... 10 2013 009 357

(51) Int. Cl.
*B66C 23/72* (2006.01)
*B66C 23/62* (2006.01)
*B66C 23/36* (2006.01)

(52) U.S. Cl.
CPC ..... *B66C 23/62* (2013.01); *B66C 23/365* (2013.01)

(58) Field of Classification Search
USPC ..... 212/291, 169, 180, 306
See application file for complete search history.

(56) References Cited

U.S. PATENT DOCUMENTS

| | | | | | |
|---|---|---|---|---|---|
| 2,143,111 | A * | 1/1939 | Hayes | 414/560 |
| 2,985,429 | A * | 5/1961 | Letournean | 254/280 |
| 3,856,150 | A * | 12/1974 | Wellman | 212/297 |
| 3,923,407 | A * | 12/1975 | Jensen et al. | 403/165 |
| 3,938,670 | A * | 2/1976 | Wellman | 212/296 |
| 3,954,193 | A * | 5/1976 | Whittingham | 414/343 |
| 4,050,587 | A * | 9/1977 | Moen | 212/301 |
| 4,053,061 | A * | 10/1977 | Lester | 212/290 |
| 4,332,328 | A * | 6/1982 | Otto et al. | 212/180 |
| 4,579,234 | A * | 4/1986 | Delago et al. | 212/178 |
| 5,176,267 | A * | 1/1993 | Pech | 212/180 |
| 5,597,078 | A * | 1/1997 | Becker et al. | 212/231 |
| 5,607,071 | A * | 3/1997 | Kroll et al. | 212/231 |
| 5,657,888 | A * | 8/1997 | Kroll et al. | 212/226 |
| 5,842,589 | A * | 12/1998 | Kroll et al. | 212/299 |
| 6,024,232 | A * | 2/2000 | Helgesson | 212/291 |
| 6,032,809 | A * | 3/2000 | Irsch | 212/181 |
| 6,039,194 | A * | 3/2000 | Beeche et al. | 212/301 |
| 7,828,162 | B2 * | 11/2010 | Wiesbauer | 212/297 |
| 2005/0150854 | A1 * | 7/2005 | Toudou et al. | 212/175 |

* cited by examiner

*Primary Examiner* — Emmanuel M Marcelo
(74) *Attorney, Agent, or Firm* — Dilworth & Barrese, LLP.

(57) ABSTRACT

The present disclosure relates to a crane, in particular to a modular mobile crane, with an under carriage, a support, and an upper carriage which comprises an upper carriage frame and a jib which can be separated from the upper carriage, wherein the under carriage comprises at least one connection point. According to the invention, the under carriage can be connected via the at least one connection point alternatively via at least one support-side connection point to the support, and to the upper carriage connected to said support, or via at least one jib-side connection point to the jib separated from the upper carriage.

20 Claims, 13 Drawing Sheets

MODULAR MOBILE CRANE

BACKGROUND OF THE INVENTION

The present invention relates to a crane, in particular to a modular mobile crane, as well as to a method for moving and displacing such a crane.

Working with large lifting heights and heavy loads requires very large cranes. Such cranes are used on large construction sites at different sites of use. The transport of a large crane up to a construction site and on the construction site is relatively expensive. Thus, it is advantageous if the crane can be moved autonomously, and if no other transport vehicles have to to be reserved at the construction site or need be transported to the construction site.

It is known that such large cranes are also very heavy, and they are frequently broken up into assembly groups for their move to the construction site. The justification for this relates to the admissible weights and to the maximum admissible or economically transportable dimensions. However, it must be kept in mind that, during the transport of a crane to the construction site or the removal transport of such a crane from the construction site, the rules of public road traffic apply and have to be complied with.

Since such rules do not apply on the construction site, large cranes can be moved on a regular basis at the construction site, in a state that is as fully equipped as possible, from one site of use to another site of use. However, the loads that the vehicle can carry are limited here as well.

If the crane is very large, in comparison to the carriage, it is technically no longer possible to move the crane in a completely equipped state. The move is then carried out in a modular manner. However, the modules then have to be assembled on site, which entails considerable costs and expenditure of time.

From DE 10 2008 047 737 A1, a mobile crane is known which can consist of different modules, such as, for example, a drive module, an equipping module, a platform module, and a support module, which can be assembled as needed. All the modules here have connection points, so that they can be coupled to each other as desired. For the construction of the crane, the modules can be assembled in accordance with the requirements of the construction site. In addition, during the refitting of the crane from transport operation to usage operation, the modules can be uncoupled, and, for example, they can also be coupled again at another location, in order to achieve a desired change in the center of gravity, or a weight compensation, for example. The drive module is then used as a counterweight, and it leads to a symmetric load distribution over the vehicle axles of the platform module. In this solution, the coupling together of two telescopic cranes with up to 14 axles has also been envisaged.

DE 20 2011 101 049 U1 describes a crane with a foldable arm which is used to raise the loads and which can be installed on commercial transport vehicles, such as trucks and other machines, for commercial uses.

The crane that is disclosed here can be carried by a transport vehicle, wherein the crane construction comprises a multiply deployable support as well as a jib.

DE 90 15 296 U1 discloses a crane which can be transported from one construction site to another construction site. This mobile crane is mounted on a trailer and it can be uncoupled from the towing vehicle. However, after the uncoupling, it can then be operated only in a supported arrangement.

DE 25 44 958 A1 shows a crane which is mounted on a trailer and which can be uncoupled from the towing vehicle. After the uncoupling, it continues to be fully movable on the construction site.

DE 20 2006 007 486 U1 discloses a mobile crane with a crane jib which can be transported separately. The installation then consists in having the jib be supported by means of attached supports, and the crane move under the jib.

DE 20 2008 016 876 U1 describes a roller rotating connection for the rotating connection of an upper carriage to the under carriage of a crane, wherein the roller rotating connection to the upper carriage and to the under carriage in each case comprises a quick connection coupling. Thus, the rotating crane can be transported separately as a transport unit with the rotary mechanism. Here, it is provided that several hydraulic motors are connected to each other, so that only one hydraulic connection needs to be established during the installation.

SUMMARY OF THE INVENTION

The aim of the present invention is to provide a crane, in particular a modular mobile crane, which can be moved rapidly and at the lowest possible cost of installation or deinstallation on a construction site, wherein the crane is able to accomplish the displacement from one site of use to another site of use as autonomously as possible. This aim is achieved, according to the invention, by a crane and method for displacing such a crane having the characteristics herein.

The crane, according to the invention, consists of an under carriage, a support, and an upper carriage which comprises an upper carriage frame and a jib that is detachable from the upper carriage, wherein the under carriage comprises at least one connection point. According to the invention, the under carriage can be connected via the at least one connection point, alternatively via at least one support-side connection point, to the support, and to the upper carriage connected to said support, or via at least one jib-side connection point to the jib separated from the upper carriage. Thus, on the construction site, according to the invention, large component groups can be transported from one site of use to another site of use largely without requiring disassembly thereof. The corresponding installation or deinstallation cost is decisively minimized as a result.

The under carriage itself thus represents an autonomously movable vehicle. Due to the detachable connection between the under carriage and the support carrying the upper carriage, the under carriage can be separated and driven away. Thus, the under carriage is also available as a fully functional transport vehicle on the construction site for other transport tasks.

As a result of this design of the crane, according to the invention, in particular of the modular mobile crane, it is achieved that the crane can accomplish the move from one site of use to another site of use in an autonomous manner. Thus, the transport cost on the construction site is decisively reduced. Due to the multiple use of the under carriage, a saving of additional transport vehicles on the construction site can be achieved.

The under carriage preferably comprises a complete vehicle having, as a rule, several drive axles and at least one drive unit, in particular a hydraulic drive. The vehicle furthermore comprises, in a manner which in itself is known, a driver cabin which is arranged in a relatively low position, so that the length of the usable transport surface area for the parts of the crane that are to be transported is increased. When the driver cabin does not project or projects only insubstantially over the surface of the under carriage, a low "loading height" above the driver cabin can be implemented. Nevertheless, the terrain accessibility required for a so-called "all terrain crane" can be achieved.

It is considered to be particularly preferable for the support to be designed in the form of support spars, in particular collapsible spars or also, on the other hand, rail spars, and to be in contact via a pot that in itself is known with the rotating connection of the upper carriage. The upper carriage can thus bear, as a fully operational crane, against the support.

It is preferable that the under carriage is detachably connected via a connection means to the support carrying the upper carriage, so that the under carriage can be detached from the upper carriage, and the under carriage can be driven away autonomously. From now on, the under carriage is available as a full-fledged transport vehicle on the construction site.

In order to improve the road transportability as well, it is preferable to also provide between the support and the rotating connection a quick connection which in itself is known. Thus, these parts can be separated rapidly and in a simple way from each other for possible road transport.

In a preferred embodiment, the crane jib is provided with additional supports, so that said crane jib can be braced in an installation position against the ground.

The aim, according to the invention, is achieved furthermore by a method for displacing a crane, in particular a modular mobile crane, having the characteristics herein.

The method, according to the invention, for displacing a crane from a first site of use to a second site of use has the following method steps:

moving the under carriage to the crane set up at a first site of use, consisting of a support and an operational upper carriage connected to it, separating the jib from the upper carriage, and connecting the jib via its at least one connection point to the at least one connection point of the under carriage, moving the jib with the under carriage to its new site of use, separating the jib from the under carriage, and placing the jib on supports, moving the under carriage under the support that has remained at the first site of use, lowering the support and the upper carriage connected to said support, and connecting the support via its at least one connection point to the at least connection point (8) of the under carriage, moving the support with the upper carriage connected to same to the new site of use, separating the support from the under carriage, and setting down the support, and installing the jib with the upper carriage with the assistance of the under carriage.

Using the above represented method, a crane according to the invention can be moved on the construction site in a very simple manner from one site of use to another site of use, largely without first having to be disassembled or reassembled. In addition, the under carriage, after the installation of the operational crane, can be displaced separately on the support on the construction site, and perform other tasks.

Preferred method embodiments can be ascertained from the description herein.

Accordingly, after the detachment of the at least one connection point, the jib can be lifted from the under carriage via the length-adjustable supports. Jibs having length-adjustable supports are in principle already known from DE 20 2006 007 486 U1, to which reference is made.

If the weights of the individual components are very large, it is also possible, during the transport on the construction site, to separate the upper carriage from the support, and to transport it separately by means of the under carriage to the new site of use, if desired. For this purpose, the upper carriage can be placed in intermediate storage on a holding rack, until the support 12 has been delivered by transport by means of the under carriage.

BRIEF DESCRIPTION OF THE DRAWINGS

Additional characteristics, details and advantages of the invention are explained in further detail below in reference to an embodiment example and its drawings. Identical or similar components are provided here with the same reference numerals.

The figures show.

DESCRIPTION OF THE PREFERRED EMBODIMENTS

Figure 1:
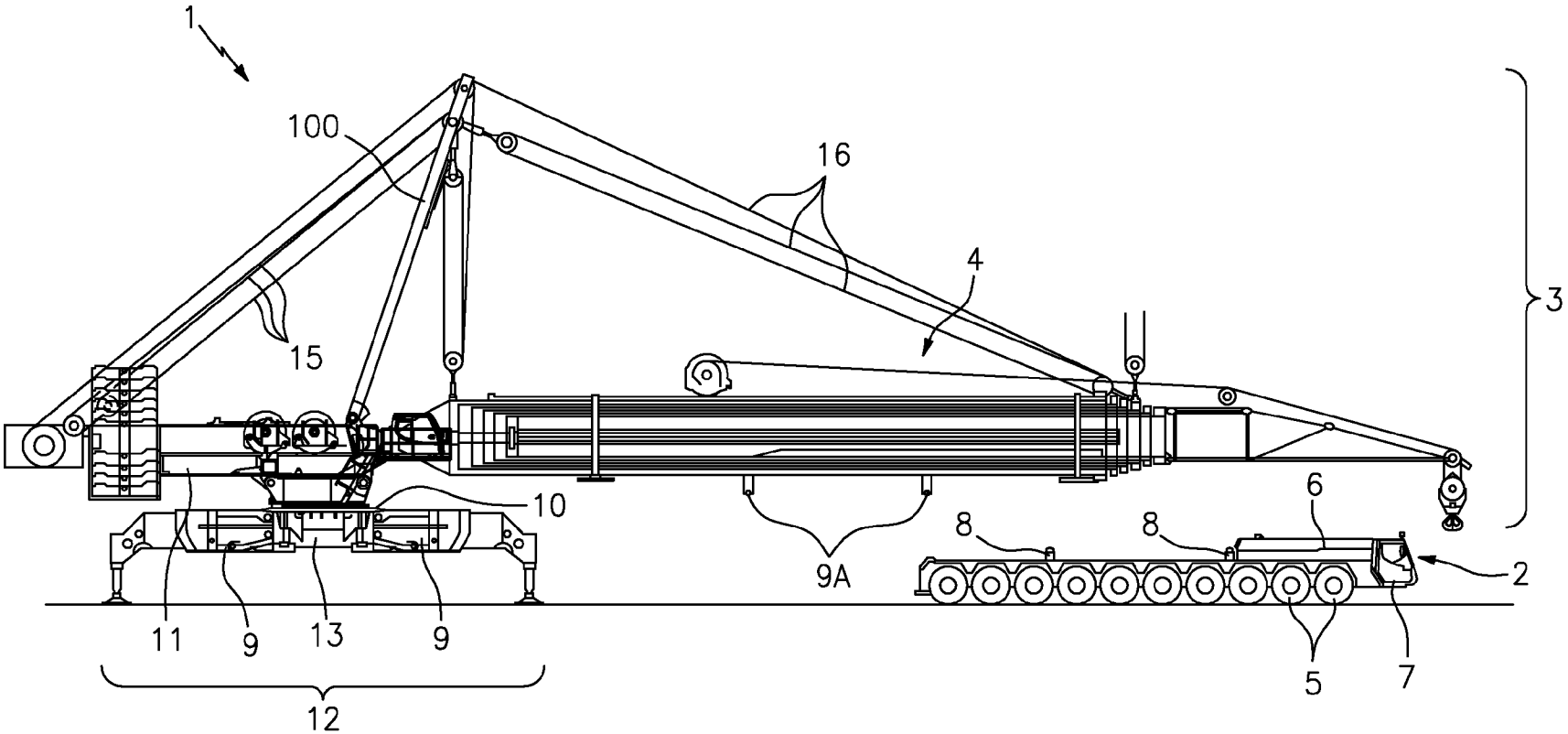
FIG. 1: a simplified diagrammatic representation of a mobile crane, according to the invention, according to an embodiment example in a side view.

FIG. 1 shows a modular mobile crane 1 which consists of an under carriage 2, a support 12, an upper carriage 3, and a jib 4 connected to the upper carriage. The lower carriage 2 is designed as a complete vehicle and it comprises several drive axles 5, as well as a drive unit 6. The under carriage 2 furthermore comprises a driver cabin 7 which, as can be seen in FIG. 1, is in a relatively low position, so that, for example, a jib deposited on the under carriage 2 can project over the driver cabin 7 (see FIG. 3).

In FIG. 1, the under carriage 2 is represented in a state separated from the support 12 and from the upper carriage 3 arranged rotatably on said under carriage. The support 12 and the upper carriage 3 together form an operational crane which is fully operational at a first site of use.

The construction of the upper carriage in itself is known. Below, only the parts required for the description of the present invention are indicated. The upper carriage 3 consists of an upper carriage frame 11, to which a jib 4 is connected by articulation, a telescopic jib, in the embodiment example represented here. The upper carriage 3 has a luffing drive 15, wherein the luffing drive 15 luffs in a known manner a trestle 100 with the jib 4. The jib 4 is firmly connected via the guy ropes 16 to the trestle 100 during crane operation. The upper carriage 3 is mounted via a rotating connection 10 (which can be seen better in FIG. 12) on the support 12.

Figure 12:
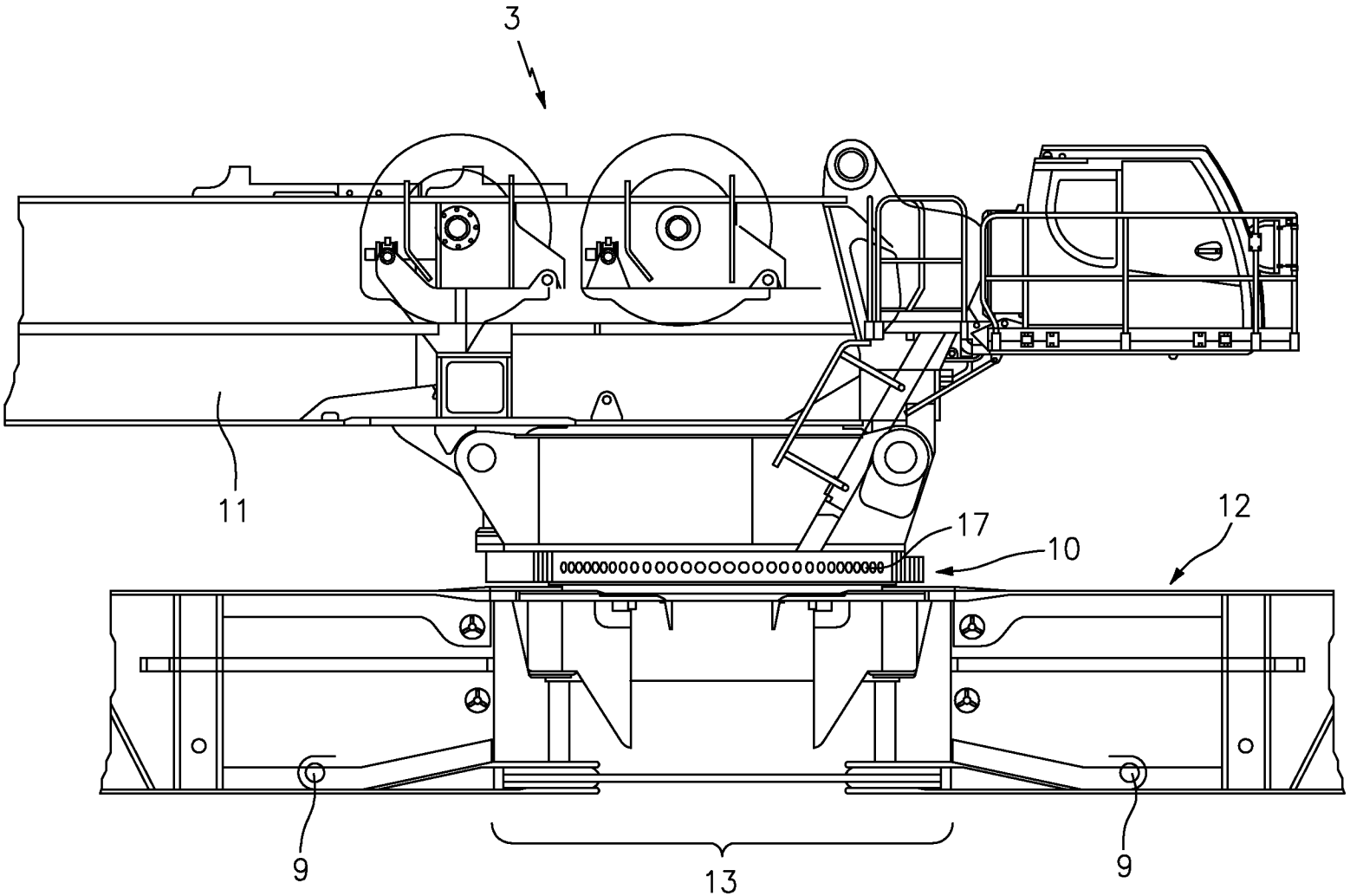
FIG. 12: a detail of the mobile crane, according to the invention, in a side view.

For a simplified disassembly of the upper carriage 3 from the support 12, which in fact may not be required for moving on the construction site, but which can be required for transport on the road, a quick connection 17 (quick connection) is provided, as can be seen in detail in FIG. 12.

The upper carriage 3 is connected to the support 12 via a pot 13 which in itself is known, in which the rotating connection 10 is arranged.

Figure 13:
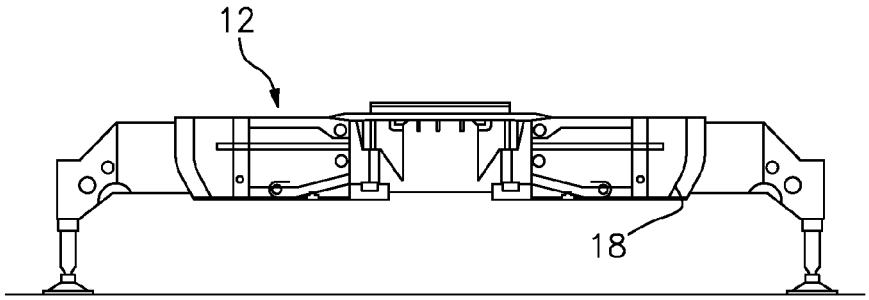
FIGS. 13-14: the support of the mobile crane, according to the invention, in a side view and a top view, in accordance with the embodiment example according to FIG. 1.
Figure 14:
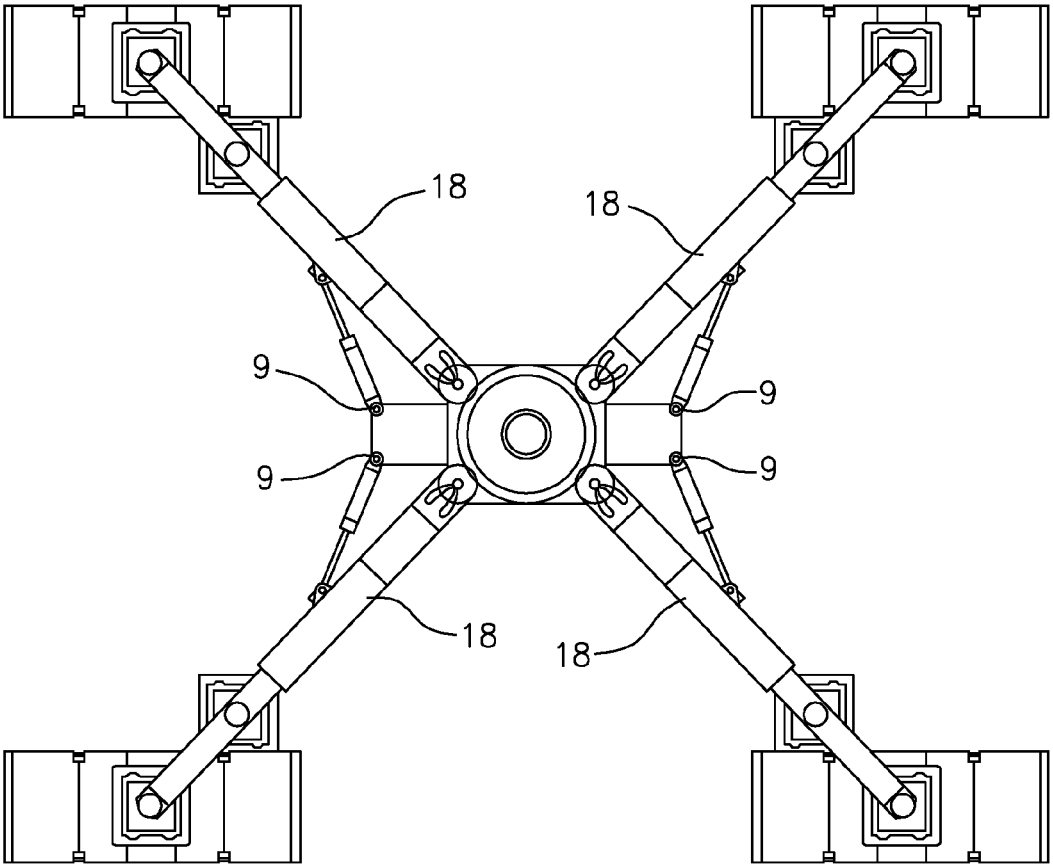

The construction of the support 12 can be seen in FIG. 1, and particularly in FIGS. 13 and 14. The support 14 has a support spar 18 which can be deployed or retracted in the usual manner. These support spars 18 are designed as rail spars in the embodiment according to FIGS. 13 and 14 represented here.

In the embodiment example represented here, the under carriage 2 comprises four connection points 8. Via these connection points 8, the under carriage can be connected alternatively via four support-side connection points 9 to the support 12 and thus to the upper carriage connected to said support. On the other hand, the under carriage 2 can be connected via four jib-side connection points 9A to the jib 4.

In the embodiment example represented here, the crane portion consisting of the upper carriage 3 and of the support 12, in the set up form represented in FIG. 1, is too heavy to be moved at the construction site from one site of use to another site of use. However, the size and weight conditions are arranged in this embodiment example so that the transport of the jib 4, on the one hand, and of the remaining upper carriage with the support 12, on the other hand, by means of the under carriage 2 is possible.

The manner of the transport is explained below in reference to the additional figures.

Figure 2:
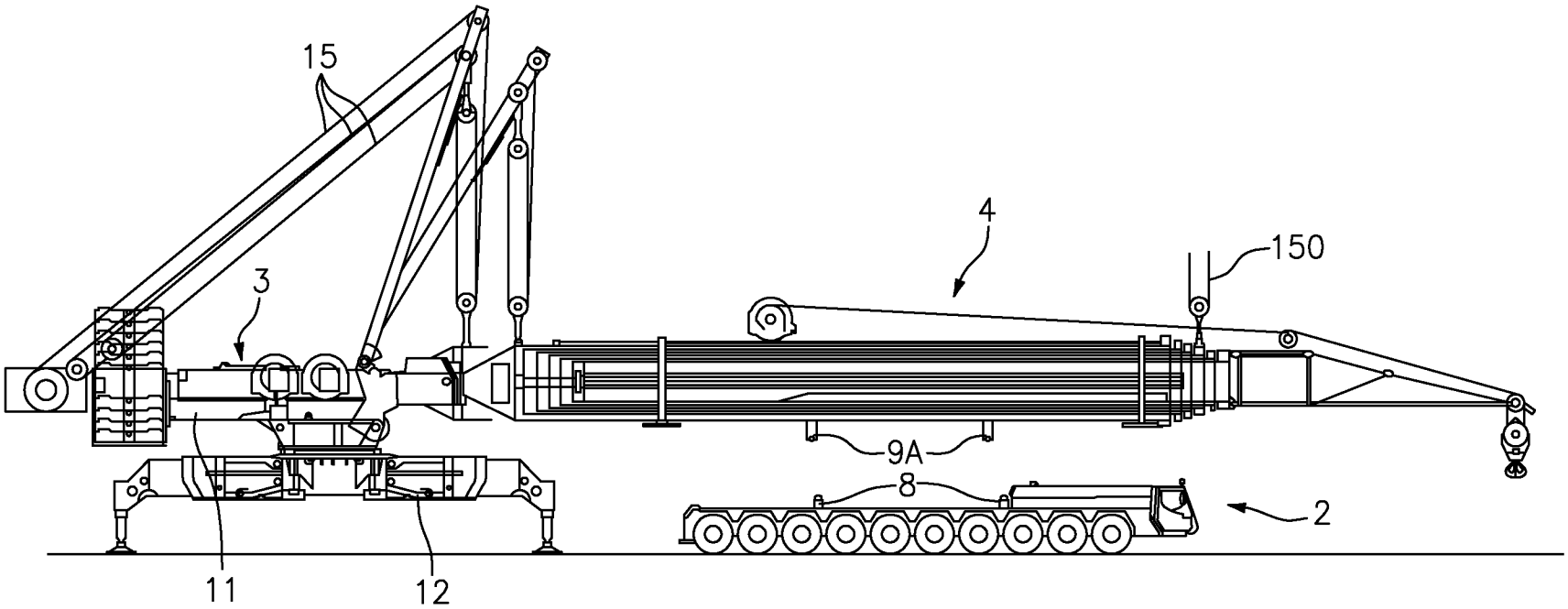
FIGS. 2-11: simplified diagrammatic representations in accordance with FIG. 1, in which different installation states of the mobile crane, according to the invention, are shown.
Figure 3:
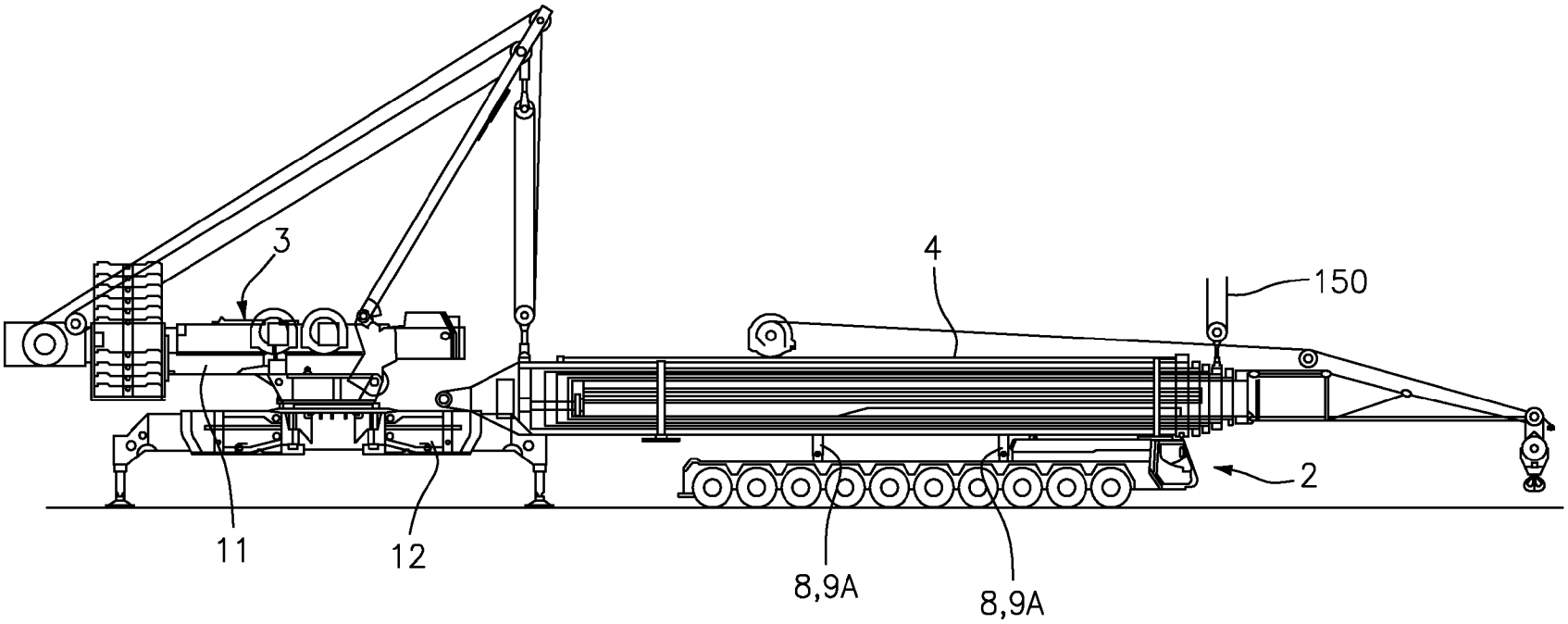
Figure 4:
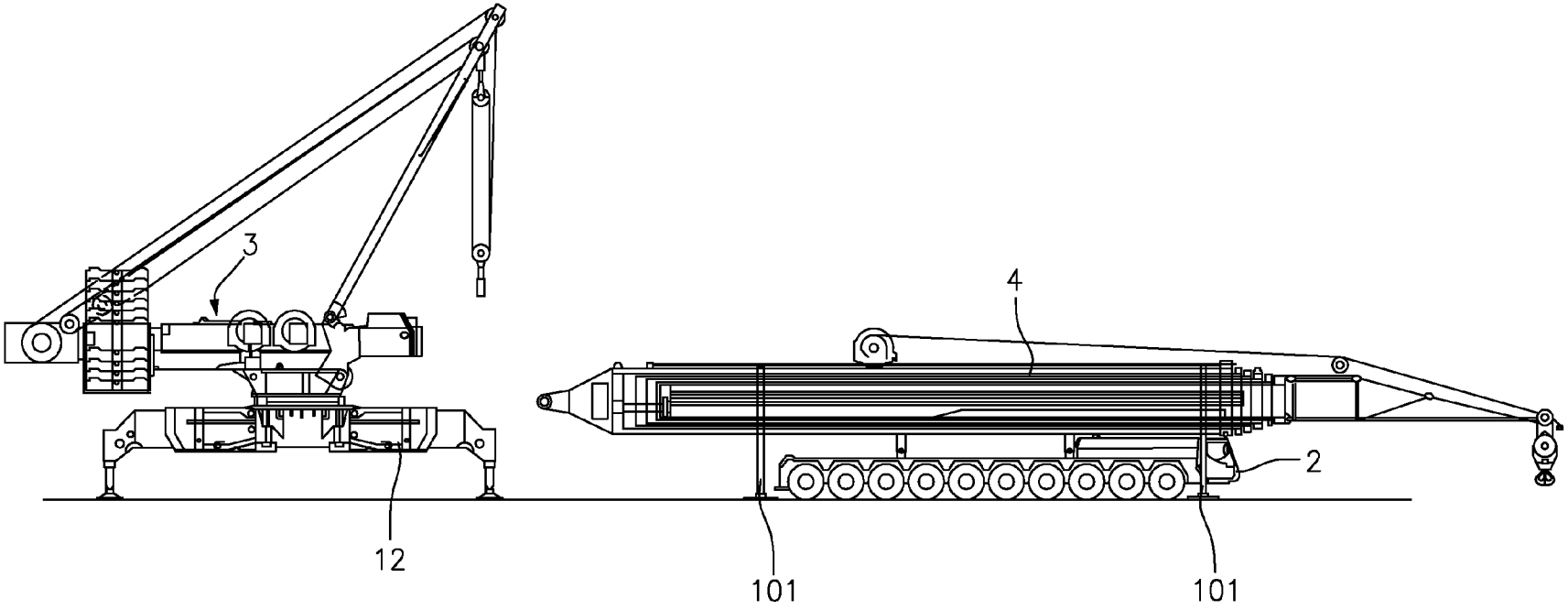

In reference to FIGS. 2, 3, 4, 5*a* and 5*b*, it is shown how, by means of the under carriage 2, the jib 4 is separated from the upper carriage 3 and transported to another site of use. As shown in FIG. 2, the jib 4 is partially lowered, on the one hand, via the upper carriage-side luffing drive 15 and, on the other hand, via an auxiliary crane 150 represented only diagrammatically here. In the representation according to FIG. 2, the luffing drive 15 is shown in two different positions. During the horizontal and substantially parallel setting down of the jib 4, the under carriage 2 moves into its receiving position. The jib 4 is separated from the remaining upper carriage 3. Via its connection points 9A, the jib 4 is then connected to the under carriage 2 via connection means not represented further here, as shown in FIG. 3. After the separation of the luffing drive and of the auxiliary crane from the jib 4, the latter is transported to the new site of use. There, telescopic supports 101, which are arranged on the jib 4 (see DE 20 2006 007 486 U1), are deployed up to a position a small distance away from the ground as a safety against overturning (see FIG. 4).

Figure 5A:
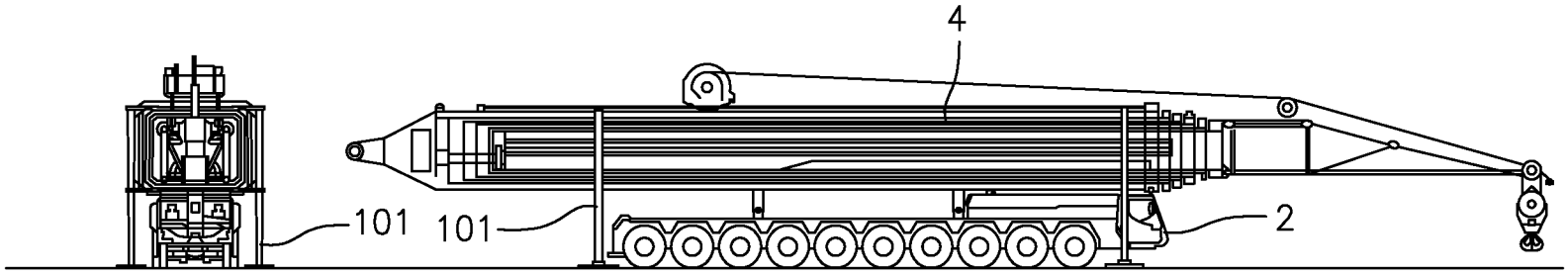
Figure 5B:
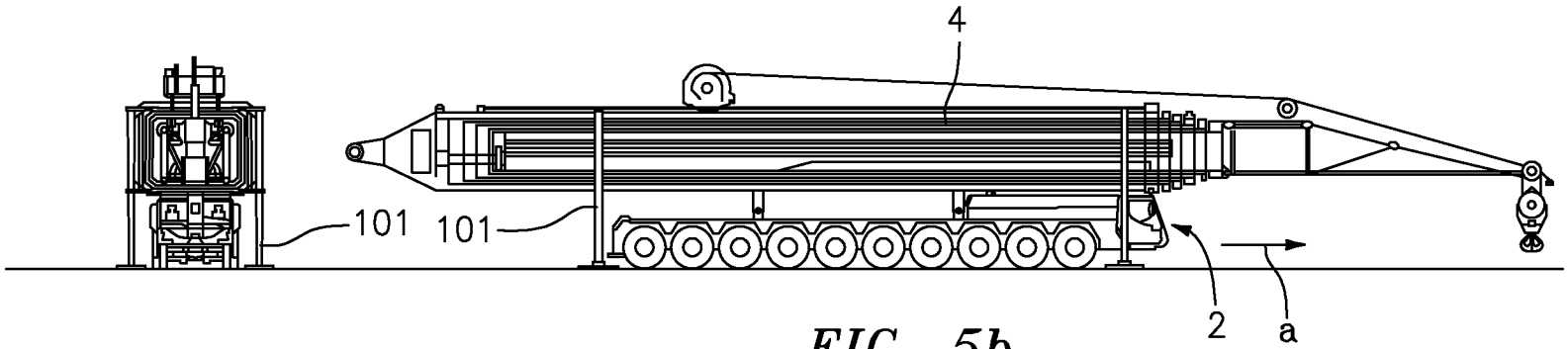
Figure 6:
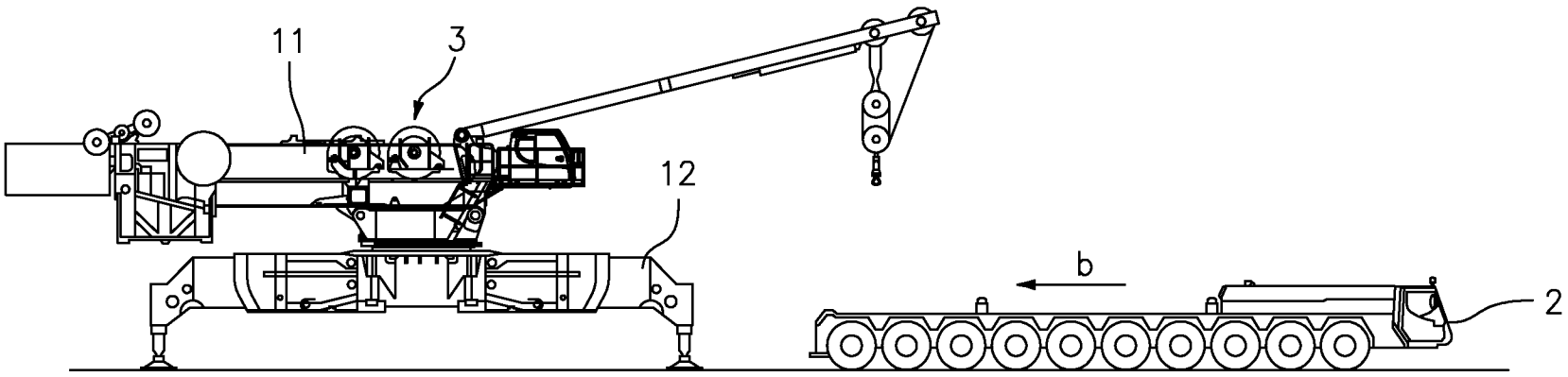

According to the representation of FIG. 5*a*, the axle suspensions of the under carriage 2 are raised to maximum separation from the ground. Subsequently, the telescopic supports 101 are extended to the ground. Finally, the axle suspensions of the under carriage 2 are lowered to a minimum. Subsequently, the connection points 8 and 9 are detached. This state is shown in FIG. 5*b*. In this position, the under carriage can be moved out in the direction of the arrow a under the elevated jib 4. Alternatively to the solution presented here, an active support 101 can also be used, which automatically raises or lowers the jib 4, without the axle suspension of the under carriage 2 having to be moved. After the jib 4 has been set down via its supports 101 at the new site of use, the under carriage 2 retrieves the remaining upper carriage with the associated support 12 that has been left at the original site of use. According to FIG. 6, the under carriage 2 is moved backward in the direction of the arrow b under the support 12. In order to lower the weight, the upper carriage ballast was taken off in accordance with the representation of FIG. 6.

Figure 7:
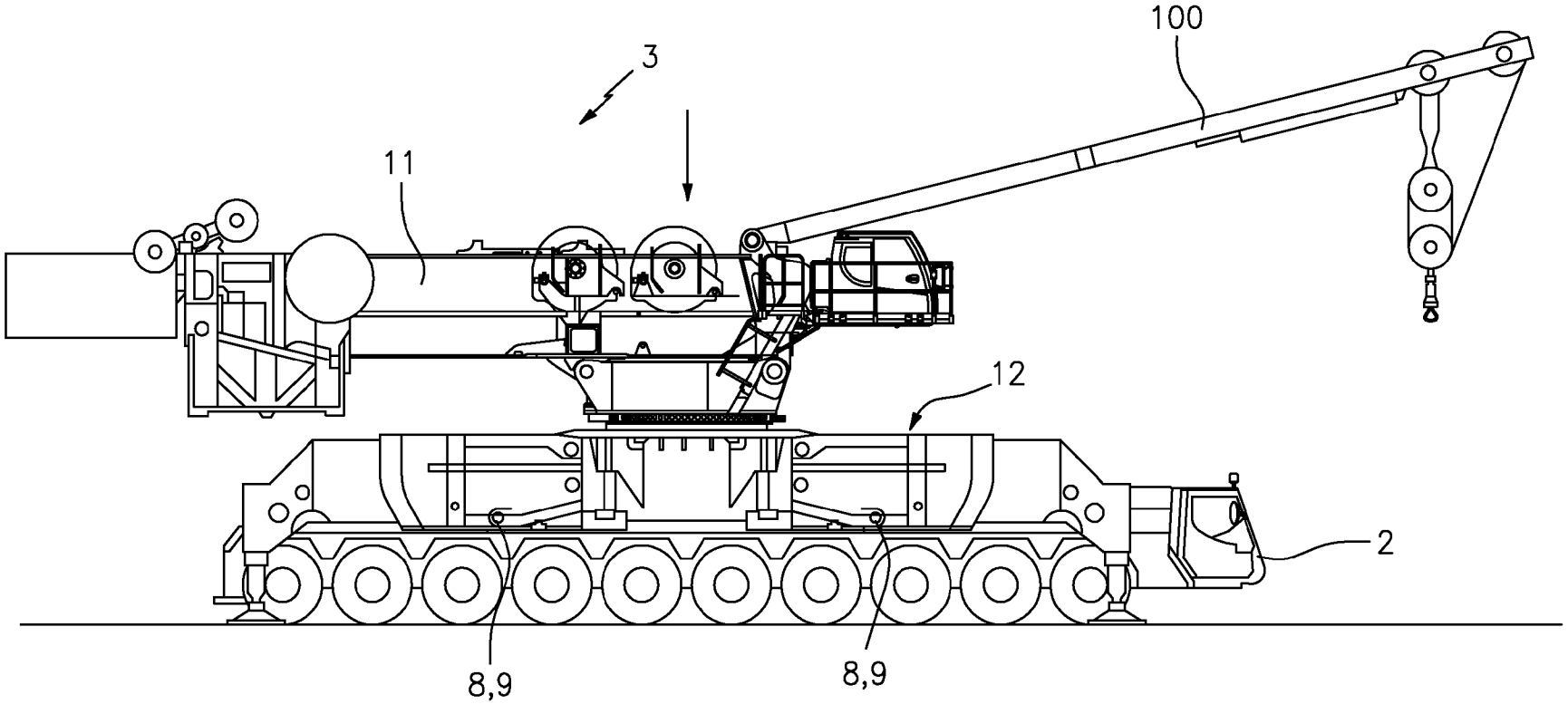

According to FIG. 7, the connection points 8 of the under carriage 2 are connected to the corresponding connection points 9 of the support 12, in order to move, after a corresponding retraction of the support spars 18 of the support 12, the remaining portion of the upper carriage 3 with the support 12 to the new site of use. Subsequently, the jib, with the assistance of the under carriage 2, is again connected to the remaining upper carriage 3, wherein the assembly occurs in reverse order, as described above in the disassembly of the jib 4 from the upper carriage 3.

In reference to FIGS. 8-11, a disassembly possibility for the jib 4 from the upper carriage 3 is described, which can occur alternatively to the one in accordance with the above description. Whereas, on the basis of FIGS. 2-5, a disassembly of the jib 4 with the assistance of an auxiliary crane 150 was described, no auxiliary crane is required in the disassembly of the jib 4, which is described below.

Figure 8:
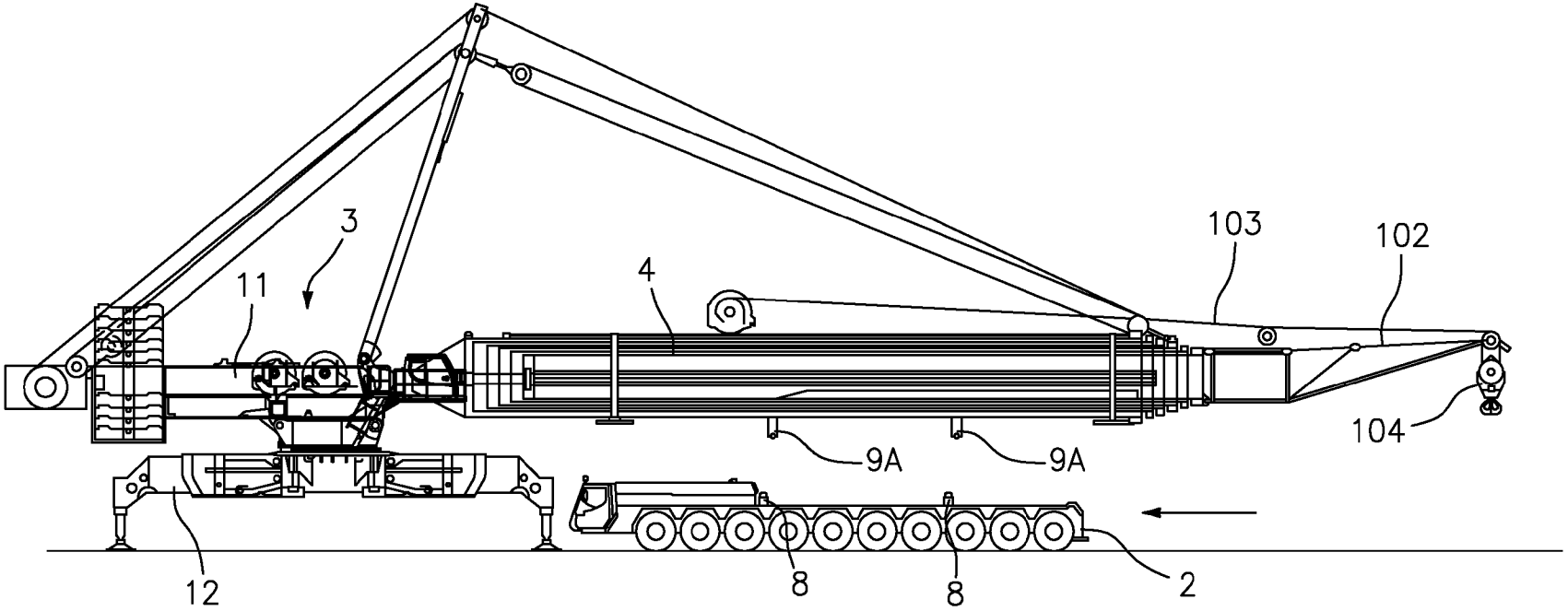
Figure 9:
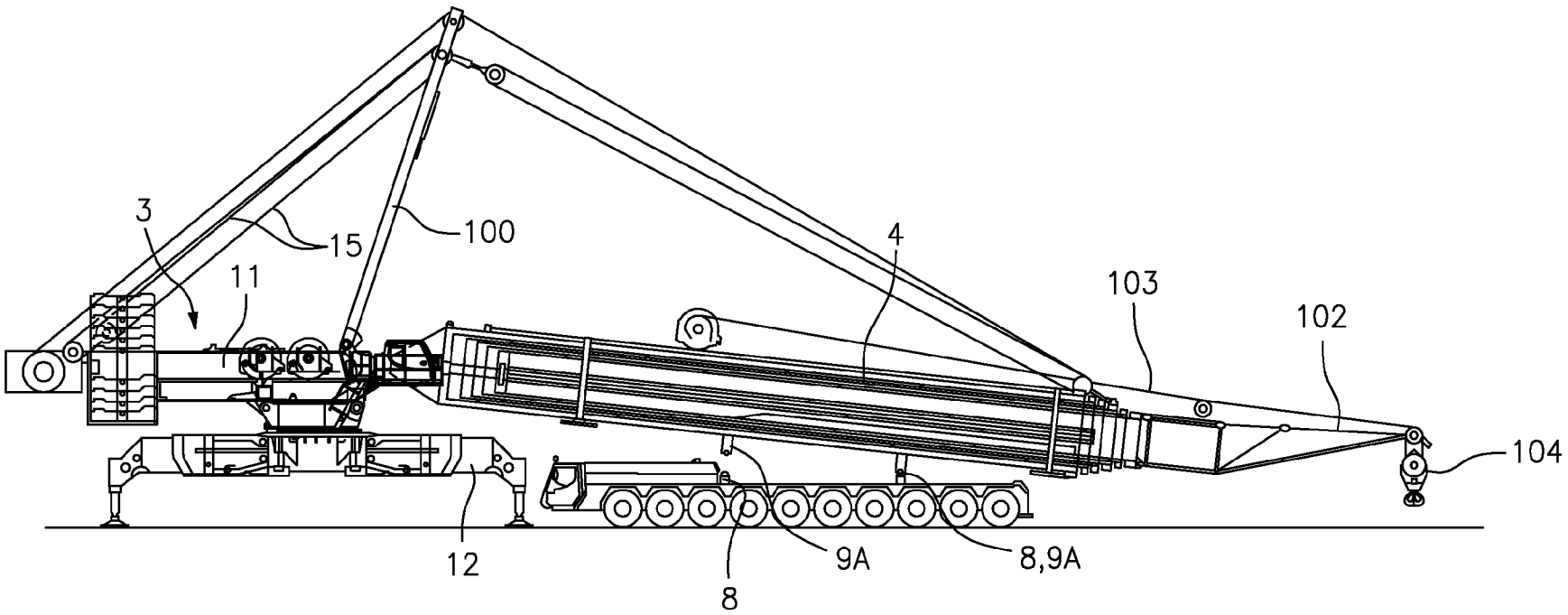
Figure 10:
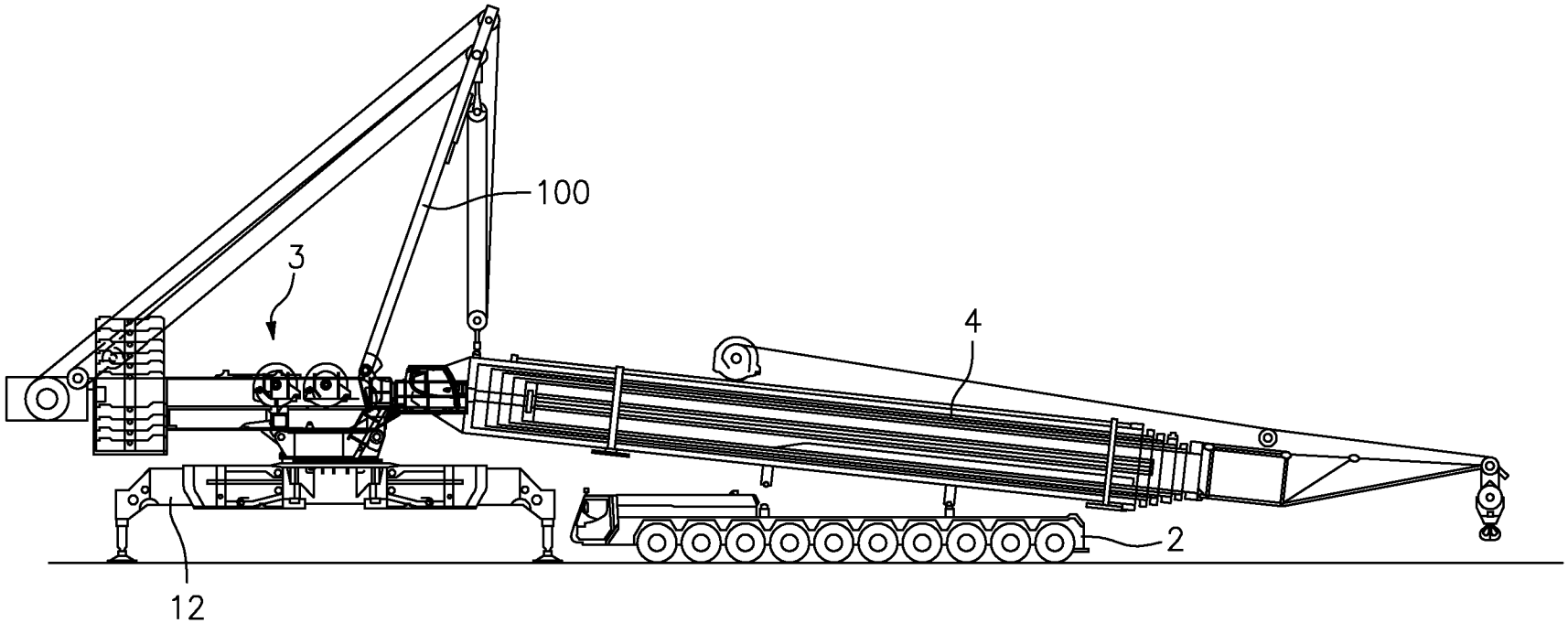

As one can see in FIG. 8, the mobile crane moves in the direction of the arrow a under the jib, wherein the driver cabin 7 is oriented here precisely on the opposite side, as in the previous process course. This occurs, because it results in more space being available for the jib 4. After the corresponding positioning of the under carriage 2, the hoist rope 103 of the jib 4 is pulled in, so that the hook block 104 is pulled in against a fixed tip 102. As a result of a further pulling in, the fixed tip is raised by a desired angle. According to FIG. 9, the front portion of the jib is subsequently lowered by means of the luffing drive so that the connection means that are not represented further here can connect the two connection points 9A—which in each case are closest to the free end of the jib 4—to the corresponding connection points 8 of the under carriage 2. This is shown in FIG. 9.

Subsequently, the luffing drive is connected to the other side of the jib (see FIG. 10); now the luffing connection of the jib to the upper carriage 3 can be undone.

Figure 11:
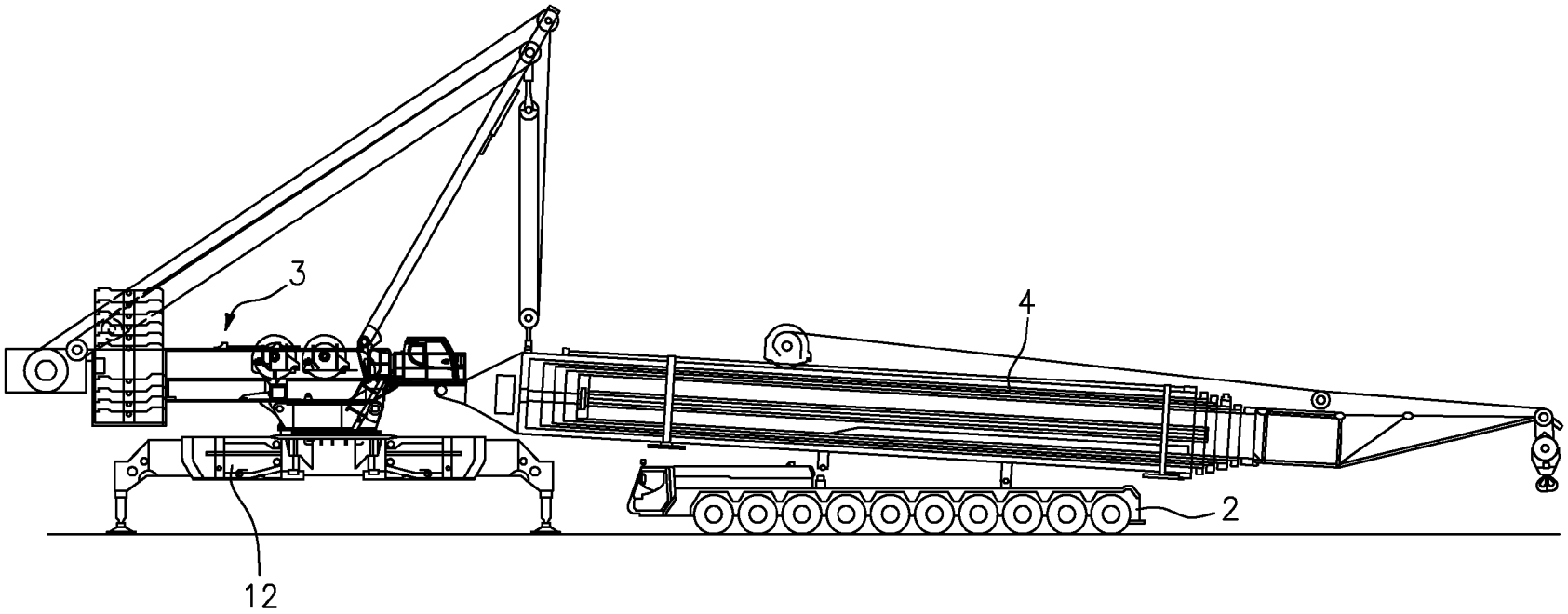

In FIG. 11, the under carriage 2 is moved some distance backward, and the jib is lowered, so that each of the two remaining connection points 9A can be connected to each other with the connection points 8 of the under carriage via connection means that are not represented further here. The jib which has thus been connected to the under carriage 2 can then be transported in the already described manner to the new site of use.

The invention claimed is:

1. Crane with an under carriage (2), a support (12), and an upper carriage (3) which comprises an upper carriage frame (11) and a jib (4) which can be separated from the upper carriage (3), wherein the under carriage (2) has at least one connection point (8), and the under carriage (2) can be connected via the at least one connection point (8), alternatively via at least one connection-side connection point (9), to the support (12), and to the upper carriage (3) connected to said support, or via at least one jib-side connection point (9A) to the jib (4) separated from the upper carriage (3).

2. Crane, according to claim 1, wherein the under carriage (2) is a vehicle with at least one drive unit (6), several drive shafts (5), as well as a driver cabin (7).

3. Crane, according to claim 2, wherein the support (12) is connectable via a pot (13) to a rotating connection (10) of the upper carriage (3).

4. Crane, according to claim 2, wherein the driver cabin (7) is arranged on the under carriage (2) in a position which is sufficiently low so that the jib (4) mounted on the under carriage (2) can project over the driver cabin (7).

5. Crane, according to claim 2, wherein the support (12) is connectable via a pot (13) to a rotating connection (10) of the upper carriage (3).

6. Crane, according to claim 2, wherein a quick connection (17) is provided between the support (12) and a rotating connection (10).

7. Crane, according to claim 6, wherein the driver cabin (7) is arranged on the under carriage (2) in a position which is sufficiently low so that the jib (4) mounted on the under carriage (2) can project over the driver cabin (7).

8. Crane, according to claim 5, wherein a quick connection (17) is provided between the support (12) and the rotating connection (10).

9. Crane, according to claim 8, wherein the driver cabin (7) is arranged on the under carriage (2) in a position which is sufficiently low so that the jib (4) mounted on the under carriage (2) can project over the driver cabin (7).

10. Crane, according to claim 5, wherein the driver cabin (7) is arranged on the under carriage (2) in a position which is sufficiently low so that the jib (4) mounted on the under carriage (2) can project over the driver cabin (7).

11. Crane, according to claim 3, wherein a quick connection (17) is provided between the support (12) and the rotating connection (10).

12. Crane, according to claim 11, wherein the driver cabin (7) is arranged on the under carriage (2) in a position which is sufficiently low so that the jib (4) mounted on the under carriage (2) can project over the driver cabin (7).

13. Crane, according to claim 3, wherein a quick connection (17) is provided between the support (12) and the rotating connection (10).

14. Crane, according to claim 13, wherein the driver cabin (7) is arranged on the under carriage (2) in a position which is sufficiently low so that the jib (4) mounted on the under carriage (2) can project over the driver cabin (7).

15. Crane, according to claim 3, wherein the driver cabin (7) is arranged on the under carriage (2) in a position which is sufficiently low so that the jib (4) mounted on the under carriage (2) can project over the driver cabin (7).

16. Crane, according to claim 1, wherein the crane jib (4) comprises supports (101) for supporting the crane jib (4) in an installation position.

17. Crane, according to claim 16, wherein the supports (101) are hydraulically length-adjustable.

18. Method for displacing a crane, according to claim 1 from a first to a second site of use, having the following method steps:

moving the under carriage (2) to the crane set up at the first site of use, having the support (12) and operational upper carriage (3) connected to it, and the jib (4), separating the jib (4) from the upper carriage (3), and connecting the jib (4) via its at least one jib-side connection point (9A) to the at least one connection point (8) of the under carriage (2), moving the jib (4) with the under carriage (2) to its new site of use, separating the jib (4) from the under carriage (2), and setting down the jib (4) on supports (101), moving the under carriage (2) under the support (12) that has remained at the first site of use, lowering the support (12) and the upper carriage (3) connected to said support, and connecting the support (12) via its at least one connection-side connection point (9) to the at least one connection point (8) of the under carriage (2), moving the support (12) with the upper carriage (3) connected to said support to the new site of use, separating the support (12) from the under carriage (2), and setting down the support (12), and installing the jib (4) with the upper carriage (3) with the assistance of the under carriage (2).

19. Method, according to claim 18, wherein after the loosening of the at least one jib-side connection point (9A), the jib (4) is lifted from the under carriage (2) via length-adjustable supports (101).

20. Method, according to claim 18, wherein if weights of individual components are large, the upper carriage (3), after a corresponding separation from the support (12), is transported separately by the under carriage (2) to the new site of use.

* * * * *